US010920944B2

(12) United States Patent
Kosta

(10) Patent No.: US 10,920,944 B2
(45) Date of Patent: Feb. 16, 2021

(54) FRAMELESS NIGHT LIGHT WITH INTERCHANGEABLE DECORATIVE FRONT COVER

(71) Applicant: Marie Spollen Kosta, Austin, TX (US)

(72) Inventor: Marie Spollen Kosta, Austin, TX (US)

( * ) Notice: Subject to any disclaimer, the term of this patent is extended or adjusted under 35 U.S.C. 154(b) by 0 days.

(21) Appl. No.: 16/455,309

(22) Filed: Jun. 27, 2019

(65) Prior Publication Data

US 2019/0346097 A1 Nov. 14, 2019

Related U.S. Application Data

(63) Continuation-in-part of application No. 15/976,835, filed on May 10, 2018, now Pat. No. 10,371,331.

(51) Int. Cl.

| | |
|---|---|
| ***F21S 8/00*** | (2006.01) |
| ***F21V 17/10*** | (2006.01) |
| ***F21V 17/12*** | (2006.01) |
| ***F21Y 115/10*** | (2016.01) |

(52) U.S. Cl.

CPC ..... *F21S 8/035* (2013.01); *F21V 17/101* (2013.01); *F21V 17/12* (2013.01); *F21Y 2115/10* (2016.08)

(58) Field of Classification Search

CPC ..... F21S 8/035; F21V 1/146; F21V 19/0055; F21V 17/12; F21V 17/002; F21K 9/232; F21W 2121/00

See application file for complete search history.

(56) References Cited

U.S. PATENT DOCUMENTS

| | | | | |
|---|---|---|---|---|
| 2,292,038 A * | 8/1942 | Benander | F21S 8/035 | 200/51.02 |
| 2,905,779 A * | 9/1959 | Schmier | H01R 13/717 | 200/51.17 |
| 3,735,118 A * | 5/1973 | Martin | F21S 8/035 | 362/644 |
| 5,622,424 A * | 4/1997 | Brady | F21S 8/035 | 362/644 |
| 7,273,312 B1 * | 9/2007 | Birchler | F21S 8/035 | 362/351 |
| 10,184,630 B1 * | 1/2019 | Wang | F21V 21/02 | |

(Continued)

FOREIGN PATENT DOCUMENTS

| | | |
|---|---|---|
| CN | 2705699 Y * | 6/2005 |
| CN | 201420998 Y * | 3/2010 |
| CN | 201683526 U * | 12/2010 |

*Primary Examiner* — Mariceli Santiago

(57) ABSTRACT

A frameless night light with interchangeable decorative front cover that solves prior inoperability of night lights that don't have easy access to the night light fixture and bulb and therefore become inoperable when the bulb and/or night light fixture ceases to work. This night light allows for easy replacement of front cover that is an improvement over many night lights wherein night light is inoperable if front cover is damaged. This night light allows for more emitted light than a traditional night light due to the light being able to shine through the front as well as all four sides (left, right, top, bottom). Night light omits the left, right, top and bottom sides that are included in many night lights, helping save on the material and manufacturing cost without loss of capability. The direct-print printing process allows the customer to choose various designs. The shape of night light is not limited to square.

7 Claims, 3 Drawing Sheets

(56) References Cited

U.S. PATENT DOCUMENTS

2005/0226006 A1* 10/2005 Chen ..... F21S 8/035
362/641
2014/0268660 A1* 9/2014 Yang ..... G09F 23/04
362/101

* cited by examiner

FRAMELESS NIGHT LIGHT WITH INTERCHANGEABLE DECORATIVE FRONT COVER

CROSS REFERENCE TO RELATED APPLICATIONS

This application claims the benefit of: Provisional patent application # U.S. 62/693,335 filed Jul. 2, 2018 by the present inventor.

This is a continuation of application Ser. No. 15/976,835 filed, with title "Frameless Decorative LED Night Light" and naming Marie Spollen Kosta as inventor, the entire content of which is hereby incorporated herein by reference in its entirety.

FEDERALLY SPONSORED RESEARCH

None

SEQUENCE LISTING

None

BACKGROUND

Prior Art

The following is a tabulation of prior art that presently appears relevant:

US Patents

| Pat. No. | Patent Issue Date | Patentee |
|---|---|---|
| 4,878,162-A | October 1989 | Wu; Arthur S |
| 5,662,408-A | September 1997 | Marischen; Joseph E |
| 3,735,118 | May 1973 | Martin, et al |
| 8,342,732-B2 | January 2013 | Chien; Tseng-Lu |

This relates to night lights, specifically to a frameless night light with interchangeable decorative front cover that contains a night light fixture and bulb. This night light solves prior inoperability of night lights due to the frameless design of the night light that allows for easy access and replacement of the bulb and/or night light fixture without loss of operability. The addition of a plastic bracket permanently affixed at the bottom of the back cover allows for the night light fixture to be removed and replaced with ease without the need to take the night light apart. This frameless night light with interchangeable decorative front cover reduces material cost and manufacturing costs by omitting the left, right, top and bottom sides that are included in many night lights as a way to enclose the night light. Many traditional night lights don't have access to the night light fixture or bulb so that when the bulb or night light fixture fails, the whole night light has to be discarded. In addition, this night light solves the problem of decorative night lights not providing enough light by using a frameless design that allows the light to shine through not only the front cover but also out all four sides of the night light (left, right, top, bottom). This night light provides versatility to the consumer who can choose to purchase additional decorative front covers that can be changed out as often as desired without the need to have separate night lights for all desired designs. The decorative image is printed directly onto the front surface and is not limited to one particular design. The ability to remove and replace decorative front covers solves the problem of traditional night lights where if the front cover is damaged, the whole night light is inoperable and must be discarded.

In conclusion, insofar as I am aware, no night light formerly developed provides a frameless design with an interchangeable decorative front cover where design is printed directly onto the front cover that allows easy access to the night light fixture and bulb. The addition of a plastic bracket permanently affixed at the bottom of the back cover allows for the night light fixture to be removed and replaced with ease as opposed to many night lights that have the night light fixture adhered permanently to the night light base. This solves prior inoperability of many night lights that have the night light fixture adhered permanently to part of the night light structure which causes these other night lights to become inoperable when a bulb or fixture fails. This frameless night light with interchangeable decorative front cover omits the left, right, top and bottom sides that are included in many night lights, which helps save on the material cost and manufacturing cost without loss of operability and makes the manufacturing process easier. This night light also provides more light than traditional night lights due to the frameless design that allows light to emanate through the front decorative cover as well as all four sides of the night light (left, right, top, bottom). The fact that the decorative image is printed directly onto the front cover provides consistency with the light shining evenly throughout the front cover as opposed to some night lights where the light is concentrated in a certain portion of the cover and is not evenly dispersed. The direct-print printing process allows the customer to choose from various designs. This direct-print printing process solves the inoperability of night lights that use a sticker affixed to the front or a picture that is inserted into the fixture. These stickers and inserts over time will peel, bend, and fade. The ability to remove and replace the decorative front cover solves the problem of inoperability of traditional night lights wherein if the front cover is damaged the night light is no longer operable.

SUMMARY

This improved night light has a frameless design with interchangeable decorative front cover made of acrylic and back cover made of acrylic adhered by two nylon screws, 4 nylon hex nuts and 2 nylon cap nuts that hold the front cover in place. This night light provides more light than traditional night lights due to the fact that bulb shines not only through the decorative front of the night light but also from all 4 openings (left side, right side, top, bottom). The addition of a plastic bracket permanently affixed at the bottom of the back cover allows for the night light fixture to be removed and replaced with ease as opposed to many nightlights that have the night light fixture adhered permanently to the night light structure. With traditional decorative night lights, if the night light fixture and/or bulb ceases to work, the whole night light needs to be thrown out because there is no access to the night light fixture or bulb to change them out and in many cases the night light fixture is affixed permanently to the night light structure. This factor solves prior inoperability of night lights that don't have easy access to the night light fixture and bulb and therefore become inoperable when the bulb and/or night light fixture ceases to work. This frameless night light with interchangeable decorative front cover omits the left, right, top and bottom sides that are included in many night lights to enclose the structure, which helps save on the material and manufacturing cost without loss of operability thus making the manufacturing process easier and cheaper. In addition, the image on the front of the night light is printed directly onto the cover while many traditional night lights either use a sticker or a system that allows for an image to be inserted into the night light cover. The fact that the image is printed directly onto the cover allows for the bulb to shine evenly through the front cover and light up the whole cover, not just the middle or certain sections of the night light. The direct-print printing process allows the customer to choose from various designs. The addition of interchangeable front covers solves the inoperability of other night lights wherein if the front cover is damaged, the whole night light is made inoperable. The LED bulb is an improvement over traditional bulbs because it is cool to the touch so it will not burn anyone who touches the bulb. The LED bulb is also extremely cost effective while producing as much light as a traditional bulb that gets hot and uses more electricity than an LED bulb.

ADVANTAGES

The Frameless Night Light with Interchangeable Decorative Covers has many advantages over prior night lights. These advantages include:

1: Ease of access to night light fixture and bulb. The addition of a plastic bracket permanently affixed to the bottom of the back cover allows for the night light fixture and bulb to be removed and replaced with ease as opposed to many nightlights that have the night light fixture adhered permanently to the night light structure.

2: Material cost savings & manufacturing cost savings: The frameless night light omits the left, right, top and bottom section that is used in many night lights to enclose the night light. This saves on material costs and manufacturing costs while providing easy access to the night light fixture and bulb.

3: Frameless design that provides more light than traditional night light because light emanates not only through the front decorative cover but also from all four sides (top, bottom, left, right)

4: The direct-print printing process allows customer to choose from various designs.

5: The direct-print printing method is an improvement on other night lights whose decorative image is adhered to the night light cover either via a sticker that will peel off over time or a design that allows a decorative image to be inserted into the front cover, which will bend and fade over time.

6: The ability to remove and replace the decorative front cover is an improvement over other night lights wherein if the cover of a traditional night light is damaged, the whole night light is then inoperable and must be discarded.

7: The shape of the invention is not limited to square.

DRAWINGS

REFERENCE NUMERALS

1 Front Cover
2 Back Cover
3 Night Light clip-on shade mounting bracket
4 Night Light Fixture UL Listed 2-prong plug polarized on left
5 LED Night Light Bulb
6 Nylon Hex nut
7 Nylon Slotted Screw
8 Nylon Cap Nut

DETAILED DESCRIPTION

Figure 1:
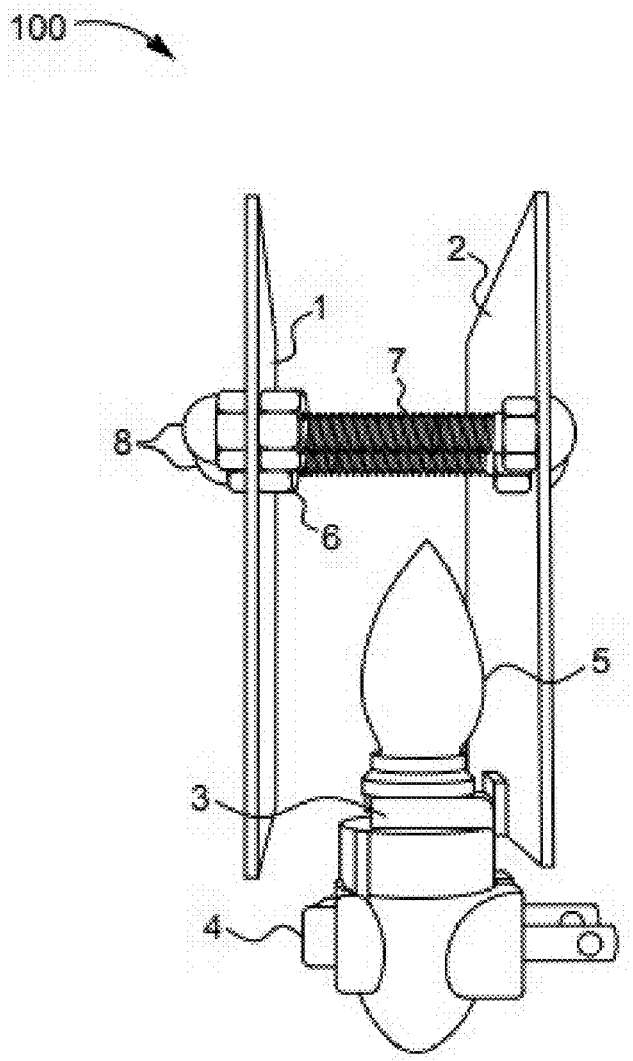
FIG. 1 is a perspective right-side view of a night light constructed in accordance with the invention, showing the night light from the user's right side view.

FIG. 1 is a perspective view taken from the user's right side of a night light constructed in accordance with the invention. Part 1 is the front cover of the night light and is made of acrylic with a decorative image printed directly onto the cover. There is a hole on both the right and left sides of Part 1, 2" up from the bottom and ¼" in from the left and right side of the cover. Part 2 is the back cover of the night light and is made of acrylic. There is a ¼" diameter hole on both the right and left sides of Part 2 back cover, 2" up from the bottom and ¼" in from the left and right side of part 2 back cover. Part 3 is the Night Light clip-on shade mounting bracket and is permanently affixed with industrial strength adhesive to Part 2 back cover on the inside of Part 2 back cover at the bottom centered between the right and left side. Part 4 is a standard night light fixture UL Listed and is clipped into Part 3 Night Light clip-on shade mounting bracket. Part 5 is an LED night light bulb and is screwed into Part 4 night light fixture. Part 6 is a Nylon finished Hex nut. Part 7 is a Nylon Machine Screw. Part 8 is a Nylon Cap Nut. Two Part 7 nylon machine screws are threaded through Part 2 back cover, one each on the left and right sides threaded from the outside of part 2 back cover. Two Part 6 nylon finished Hex nuts are screwed onto Part 7 screw, one each on the left and right side, all the way down the screw so that Part 2 back cover is between part 6 nylon finished hex nut and part 7 screw. Two Part 6 nylon finished hex nuts are threaded onto Part 7 screw, one each on left and right side so that there is ¼ of Part 7 screw between nylon finished hex nut and end of screw. Part 1 front cover is inserted through part 7 screws via the holes on the left and right side of part 1 front cover and rests upon part 6 nylon finished hex nut. Part 8 cap nuts are attached to part 7 screw so that part 8 cap nuts hold part 1 front cover in place. Part 1 front cover is surrounded on inside by two Part 6 nylon finished hex nuts and on outside decorative portion of part 1 by two Part 8 cap nuts. To replace front cover, part 8 cap nuts are removed from part 1 front cover by unscrewing, part 1 front cover is removed from night light structure and new part 1 front cover is inserted through part 7 screws via the holes on the left and right and sits on top of part 6 nylon finished hex nuts. Part 8 Nylon cap nuts are screwed onto part 7 screws, one each on right and left side so that replacement part 1 front cover is held in place with two part 8 cap nuts, one each on left and right sides. Part 3 Night Light clip-on shade mounting bracket, Part 4 night light fixture and part 5 night light bulb are facing inward and are between Part 1 front cover and Part 2 back cover.

Figure 2:
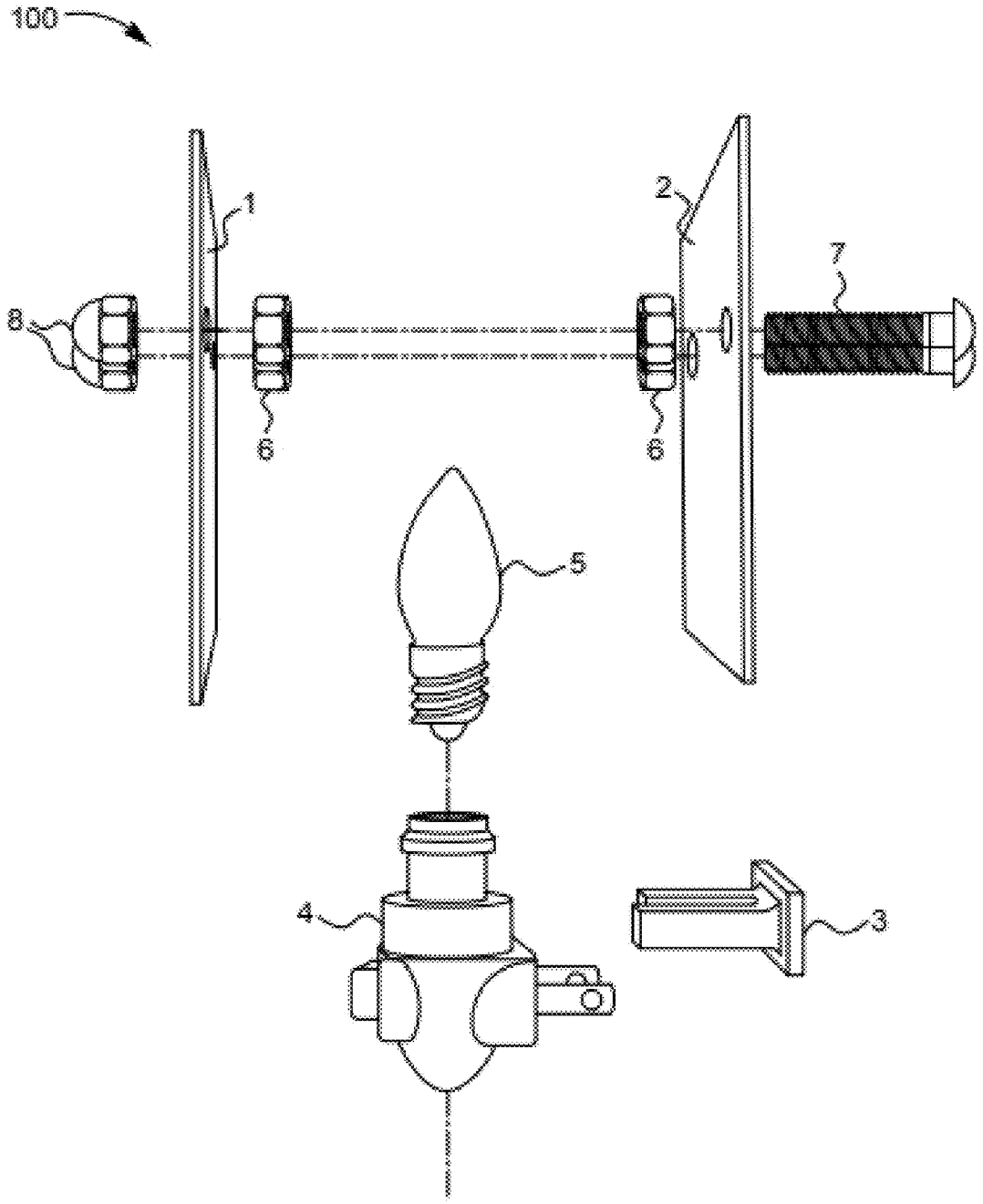
FIG. 2 is an exploded view showing the construction of a night light constructed in accordance with the invention, showing the night light from the user's right side view.

FIG. 2 is an exploded view showing the construction of a night light constructed in accordance with the invention, showing the night light from the user's right side view. Part 1 is the front cover of the night light and is made of acrylic with a decorative image printed directly onto the cover. There is a hole on both the right and left sides of Part 1, 2" up from the bottom and ¼" in from the left and right side of the cover. Part 2 is the back cover of the night light and is made of acrylic. There is a ¼" diameter hole on both the right and left sides of Part 2 back cover, 2" up from the bottom and ¼" in from the left and right side of part 2 back cover. Part 3 is the Night Light clip-on shade mounting bracket and is permanently affixed with industrial strength adhesive to Part 2 back cover on the inside of Part 2 back cover at the bottom centered between the right and left side. Part 4 is a standard night light fixture UL Listed and is clipped into Part 3 Night Light clip-on shade mounting bracket. Part 5 is an LED night light bulb and is screwed into Part 4 night light fixture. Part 6 is a Nylon finished Hex nut. Part 7 is a Nylon Machine Screw. Part 8 is a Nylon Cap Nut. Two Part 7 nylon machine screws are threaded through Part 2 back cover, one each on the left and right sides threaded from the outside of part 2 back cover. Two Part 6 nylon finished Hex nuts are screwed onto Part 7 screw, one each on the left and right side, all the way down the screw so that Part 2 back cover is between part 6 nylon finished hex nut and part 7 screw. Two Part 6 nylon finished hex nuts are threaded onto Part 7 screw, one each on left and right side so that there is ¼" of Part 7 screw between nylon finished hex nut and end of screw. Part 1 front cover is inserted through part 7 screws via the holes on the left and right side of part 1 front cover and rests upon part 6 nylon finished hex nut. Part 8 cap nuts are attached to part 7 screw so that part 8 cap nuts hold part 1 front cover in place. Part 1 front cover is surrounded on inside by two Part 6 nylon finished hex nuts and on outside decorative portion of part 1 by two Part 8 cap nuts. To replace front cover, part 8 cap nuts are removed from part 1 front cover by unscrewing, part 1 front cover is removed from night light structure and new part 1 front cover is inserted through part 7 screws via the holes on the left and right and sits on top of part 6 nylon finished hex nuts. Part 8 Nylon cap nuts are screwed onto part 7 screws, one each on right and left side so that replacement part 1 front cover is held in place with two part 8 cap nuts, one each on left and right sides. Part 3 Night Light clip-on shade mounting bracket, Part 4 night light fixture and part 5 night light bulb are facing inward and are between Part 1 front cover and Part 2 back cover.

Figure 3:
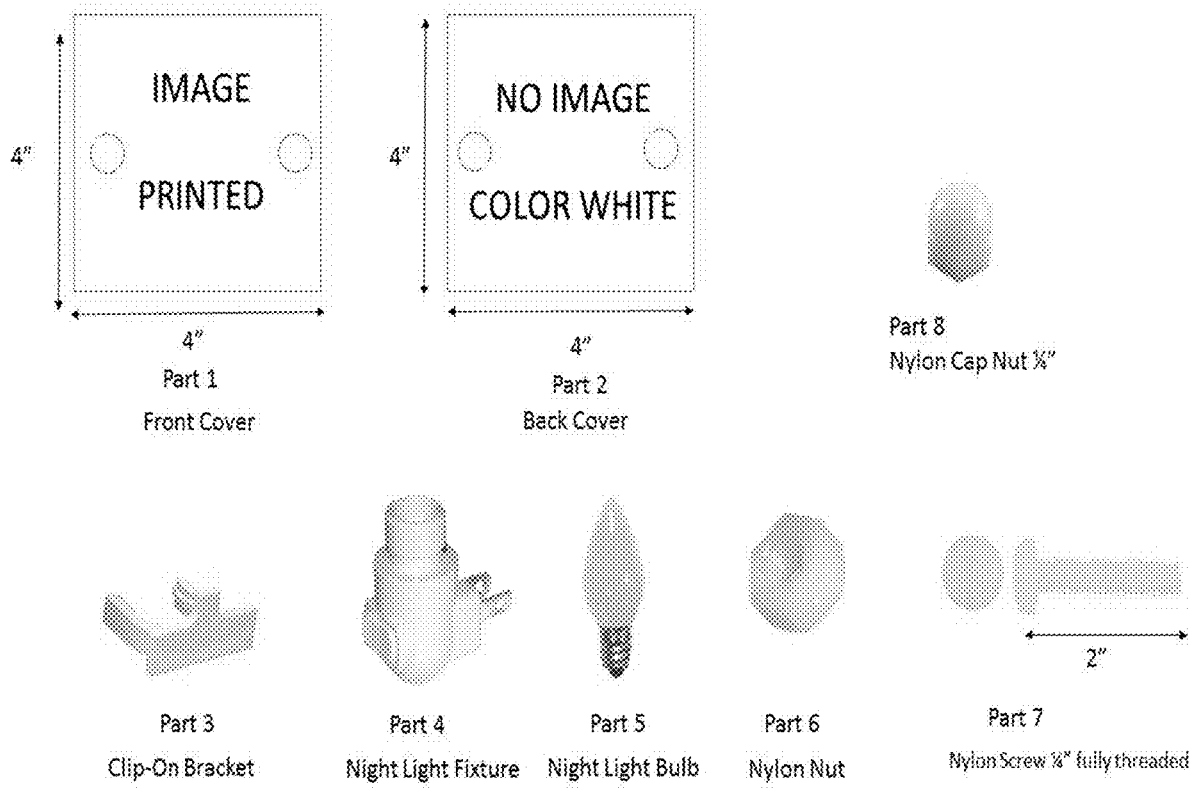
FIG. 3 is a diagram of patent parts along with reference numerals

FIG. 3 is a diagram showing each part along with reference numerals.

Operation

In operation one uses the night light in a similar manner to other decorative night lights by plugging into a wall outlet and turning on the switch. Frameless Night Light With Interchangeable Decorative Front Cover includes night light fixture and LED bulb. Decorative Front Cover has the ability to be removed and replaced easily. If the night light fixture and/or bulb ceases to work, the night light design allows for easy removal and replacement of bulb and/or night light fixture due to frameless design and addition of plastic bracket affixed permanently to the bottom of the back cover that allows the night light fixture to pop in and out of the bracket. This night light provides more light than traditional night lights due to the frameless design that allows light to emit not only through the front decorative color but also from all four sides (top, bottom, left, right).

CONCLUSION

The Frameless Night Light With Interchangeable Decorative Front Cover has many advantages over prior night lights. These advantages include:

1: Ease of access to night light fixture and bulb. The addition of a plastic bracket at the bottom of the back cover allows the night light fixture to be removed and replaced with ease as opposed to many night lights that have the night light fixture adhered permanently to the night light structure.

2: The frameless night light omits the left, right, top and bottom section that is used in many night lights to enclose the night light. This saves on material costs and manufacturing costs while providing easy access to the night light fixture and bulb.

3: Frameless design that provides more light than traditional night light because light emanates not only through the front decorative cover but also from all four sides (top, bottom, left, right)

4: The direct-print printing process allows customer to choose from various designs.

5: The direct-print printing method is an improvement on other night lights whose decorative image is adhered to the night light cover either via a sticker that will peel off over time or a design that allows a decorative image to be inserted into the front cover, which will bend and fade over time.

6: The ability to remove and replace the decorative front cover is an improvement over other night lights wherein if the front cover of a traditional night light is damaged, the whole night light is then inoperable and must be discarded.

I claim:

1. A frameless night light with interchangeable decorative front cover comprising:

a front cover
a back cover
a bracket
a night light fixture
a light bulb; and
screws and nuts, wherein the back cover is permanently held in place by screws and nuts, wherein the front decorative cover is held in place by nuts that can be unscrewed to allow for the decorative cover to be removed and replaced without damaging the structure of night light, wherein the bracket is permanently affixed to the back cover with adhesive, wherein night light fixture snaps into the bracket and can be accessed without taking the frameless night light apart and without damaging the frameless night light with interchangeable decorative front cover, wherein light bulb can be accessed and replaced without taking night light apart.

2. The frameless night light with interchangeable decorative front cover according to claim 1, wherein the night light fixture is held in place in the bracket but not permanently affixed and can be removed and replaced without taking apart the frameless night light with interchangeable decorative front cover.

3. The frameless night light with interchangeable decorative front cover according to claim 1, wherein the night light fixture is a separable, independent part that can be removed and replaced without taking apart the frameless night light with interchangeable decorative front cover.

4. The frameless night light with interchangeable decorative front cover according to claim 1, wherein the only connection between the front and back cover is two screws inserted into left and right side of front and back covers and nuts holding screws in place whereby the frameless night light with interchangeable decorative front cover will not come apart if pulled on.

5. The frameless night light with interchangeable decorative front cover according to claim 1, wherein a decorative image is printed onto the front cover wherein the decorative image can have various designs.

6. The frameless night light with interchangeable decorative front cover according to claim 1, wherein the decorative aspect of frameless night light with interchangeable decorative front cover is due to the image printed on the front of the frameless night light with interchangeable decorative front cover and not the shape of the frameless night light, resulting in the ability to create a variation of designs.

7. The frameless night light with interchangeable decorative front cover according to claim 1, wherein decorative front cover is held in place by screws and can be removed and replaced without damaging the structure of the frameless night light with interchangeable front cover.

* * * * *